US005816008A

United States Patent [19]

Hohmann

[11] Patent Number: 5,816,008

[45] Date of Patent: Oct. 6, 1998

[54] T-HEAD, BRICK VENEER ANCHOR

[75] Inventor: Ronald P. Hohmann, Syosset, N.Y.

[73] Assignee: Hohmann & Barnard, Inc.

[21] Appl. No.: 867,236

[22] Filed: Jun. 2, 1997

[51] Int. Cl.[6] ..... E04B 1/38

[52] U.S. Cl. ..... 52/565; 52/379; 52/434; 52/713; 52/513

[58] Field of Search ..... 52/562, 564, 565, 52/513, 511, 379, 383, 713, 714, 434; 248/222.3, 225.11, 207, 244

[56] References Cited

U.S. PATENT DOCUMENTS

| | | | |
|---|---|---|---|
| 1,828,618 | 10/1931 | Pieters | 52/379 |
| 3,377,764 | 4/1968 | Storch | 52/379 X |
| 4,021,990 | 5/1977 | Schwalberg | 52/479 |
| 4,373,314 | 2/1983 | Allan | 52/379 |
| 4,382,416 | 5/1983 | Kellogg-Smith | 248/222.3 |
| 4,473,984 | 10/1984 | Lopez | 52/379 X |
| 4,606,163 | 8/1986 | Catani | 52/513 X |
| 4,827,684 | 5/1989 | Allan | 52/379 |
| 4,869,038 | 9/1989 | Catani | 52/712 X |
| 4,875,319 | 10/1989 | Hohmann | 52/508 X |
| 4,955,172 | 9/1990 | Pierson | 52/379 X |
| 5,392,581 | 2/1995 | Hatzinikolas et al. | 52/379 X |
| 5,408,798 | 4/1995 | Hohmann | 52/562 |
| 5,454,200 | 10/1995 | Hohmann | 52/513 |
| 5,490,366 | 2/1996 | Burns et al. | 52/565 X |

FOREIGN PATENT DOCUMENTS

| | | | |
|---|---|---|---|
| 1082943 | 8/1980 | Canada | 52/562 |

*Primary Examiner*—Winnie S. Yip
*Attorney, Agent, or Firm*—Siegmar Silber

[57] ABSTRACT

A brick veneer anchor for use in the construction of wall structures is described. The anchor has an L-shaped plate for attachment to a dry wall installation. The L-shaped plate attaches to the outer surface of the inner wythe and has a portion thereof extending beyond an insulative layer into and terminating within the cavity between the inner and outer wythes. An elongated slot in the dry wall anchor accepts a bent stay with one end interlocking with the elongated slot portion and the other end embedded within the outer wythe. The bent stay has a T-head portion with a length greater than the longitudinal axis of the slot. The bent stay also has a neck portion attached to T-head portion which forms shoulders on either side of the T-head portion. The dry wall anchor, upon attachment to the inner wythe, has one end of the bent stay inserted into the elongated slot and the other end of the bent stay embedded in the outer wythe. Then, the bent stay and the dry wall anchor are positively interlocked the one to the other and forms a wall structure resistant to seismic forces.

15 Claims, 5 Drawing Sheets

T-HEAD, BRICK VENEER ANCHOR

BACKGROUND OF THE INVENTION

1. Field of the Invention

This invention relates to an improved brick veneer anchor with an L-shaped, bent plate attachment portion and an interconnecting T-head bent stay portion for use in conjunction with a wall structure having an inner wythe and an outer wythe. The invention is particularly designed for constructs in which the inner wythe is a dry wall and the outer wythe is a brick veneer. In one embodiment hereof, the invention relates to construction accessory devices for surface mounting veneer anchors and for embedding the corrugated end of the T-head bent stay in the bed joints of the outer wythe. In another embodiment hereof, these accessory devices besides being adapted for embedment in the bed joint of the brick veneer also capture therewithin continuous reinforcement wires. This embedment resists disengagement of the brick veneer under seismic or other high-stress conditions.

2. Description of the Prior Art

In the past, investigations relating to the effects of various forces upon brick veneer masonry construction have demonstrated the advantages of continuous wire embedment in the mortar joint of anchored veneer walls. The seismic aspect of these investigations were referenced in the inventor's prior patents, namely U.S. Pat. No. 4,875,319; 5,408,798; and 5,454,200. Besides earthquake protection, the failure of the veneer anchoring of several high-rise buildings to withstand wind and other lateral forces has resulted in the incorporation of a requirement for continuous wire reinforcement in the Uniform Building Code provisions. The inventor's related Seismiclip®, Byna-Tie®, and DW-10-X® products (manufactured by Hohmann & Barnard, Inc., Hauppauge, N.Y. 11788) have become widely accepted in the industry. The use of a mounting arrangement for brick veneer facing, as described infra, has also been found to provide protection against problems arising from thermal expansion and contraction and improvement in the uniformity of the distribution of lateral forces in a structure. The following patents are believed to be relevant and are put forth as being useful in this discussion of the prior art:

| Patent | Inventor | Issue Date |
|---|---|---|
| 3,377,764 | Storch | 04/16/1968 |
| 4,021,990 | Schwalberg | 05/10/1977 |
| 4,373,314 | Allan | 02/15/1983 |
| 4,473,984 | Lopez | 10/02/1984 |
| 4,869,038 | Catani | 09/26/1989 |
| 4,875,319 | Hohmann | 10/24/1989 |
| 5,408,798 | Hohmann | 04/25/1995 |
| 5,454,200 | Hohmann | 10/03/1995 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety without positive restriction against escape upon vertical displacement.

U.S. Pat. No. 3,377,764—D. Btorch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314—J. A. Allan—Issued Feb. 2, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued 091/26/89

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheet-metal anchor. Wall tie is distinguished over that of Schwalberg '990 and is clipped onto a straight wire run.

U.S. Pat. No. 5,408,798—R. Hohmann—Issued Apr. 25, 1995

Discloses a veneer anchoring system wherein wire formative wall ties are used to provide connections between and embedded wire structures in inner and outer wythes. Combines wire wall tie technology clip member of Hohmann '319 patent.

U.S. Pat. No. 5,454,200—R. Hohmann—Issued Oct. 3, 1995

Discloses a veneer anchoring system wherein wire formative wall ties are used to provide wire-to-wire connections between and embedded wire structures in inner and outer wythes. Vertical misalignments are compensated by various devices.

None of the above provide a brick veneer anchor for a dry wall application wherein the anchor permits and limits movement of the brick veneer along two axes and, after the mechanical threshold is reached, restrains the further movement of the brick veneer. The anchor optionally interconnects with a reinforcement bar embedded in the bed joint of the brick veneer as described hereinbelow.

SUMMARY

In general terms, the invention disclosed hereby includes a brick veneer anchor for use in the construction of a wall having an inner wythe—in the best mode, a dry wall construction and an outer wythe—in the best mode, a brick veneer facing. The wythes are in a spaced apart relationship and form a cavity therebetween. In the disclosed brick veneer anchor, a unique combination of an L-shaped plate and an bent stay is provided. The invention contemplates that the primary components—the L-shaped plate and the T-Head bent stay provide for positively interlocked connections therebetween.

In the first embodiment of this invention, the inner wythe is a dry wall constructed metal studs and dry wall panels mounted thereon. The dry wall also includes an insulative layer mounted on the exterior surface. The L-shaped plate is secured to the studs by self-tapping, stainless steel screws and protrudes through the insulation into the cavity. The protrusion includes an elongated slot through which a T-Head, bent stay is interconnected. The L-shaped plate is adapted for mounting with the elongated slot portion normal to the dry wall and is described hereinbelow with the elongated slot portion disposed in a horizontal plane. Although not uniformly required, many building codes include a reinforcement wire provision and the T-Head bent stay is preferably secured to at least one reinforcement wire, which is also embedded in the bed joint of the brick veneer.

With the slot horizontal, a bent stay is employed and the T-Head end is rotated into positive engagement with the elongated slot. The other end is placed in the bed joint of the brick veneer and embedded in mortar. In the first embodiment, the embedded end has reinforcement wire capturing tabs.

In the second embodiment, with the slot again horizontal, a T-head, bent stay is employed having in the interconnecting portion, a T-head that is longer than the opening of the slot and a neck attaching it to the veneer-anchoring portion of the bent stay. Upon insertion, the T-head end of the bent stay is rotated into engagement with the elongated slot and the other end is embedded in the bed joint of the brick veneer. Upon embedment, the other end is held horizontal and positive interlocking of the bent stay and the bent plate results.

In all the embodiments a variety of bent stay end designs for connecting with reinforcement wires are utilizable. The one shown utilizes stamped capturing tabs; however, other arrangements for caputring the reinforcement wire(s) are suggested, infra.

In the descriptions of the preferred embodiments axes are drawn so that the spatial relationships among the components can be readily described and understood. With the axes stated, alternative arrangements for the mounting the components are readily described.

OBJECTS AND FEATURES OF THE INVENTION

It is an object of the present invention to provide labor-saving devices to aid in the installation of a brick veneer and the securement thereof to a dry wall construct.

It is another object of the present invention to provide a brick veneer anchor comprising a limited number of component parts that are economical of manufacture resulting in a relatively low unit cost.

It is yet another object of the present invention to provide in a wall structure having a brick veneer and an insulated, dry wall interior wall, a brick veneer anchor connected to a continuous wire reinforcement in the bed joint of the brick veneer.

It is yet a further object of the present invention to provide a brick veneer anchor which interlocks the stud arrangement of the interior wythe with the continuous wire reinforcements of the exterior wythe in a positive manner such that the connector portion in the cavity between the wythes cannot separate.

It is a further object of the present invention to provide a veneer anchor brick veneer anchor comprising a limited number of component parts that are economical of manufacture resulting in a relatively low unit cost.

It is yet another object of the present invention to provide a brick veneer anchor which limits lateral and vertical movements of the facing wythe with respect to the inner wythe, but is adjustable vertically, and the x- and y-axis movements of the facing wythe with respect to the inner wythe, but is fixed in the remaining axis (the z-axis);

It is a feature of the present invention that the outer wythe anchor, after being rotatedly inserted into the elongated slot has in the free end thereof, a corrugation to enhance èmbedment thereof and alternatively a reinforcement wire capturing device.

Other objects and features of the invention will become apparent upon the review of the drawings and detailed description which follow.

BRIEF DESCRIPTION OF THE DRAWINGS

In the following drawings, the same parts of the various views are afforded the same reference designators.

DESCRIPTION OF THE PREFERRED EMBODIMENTS

Figure 1:
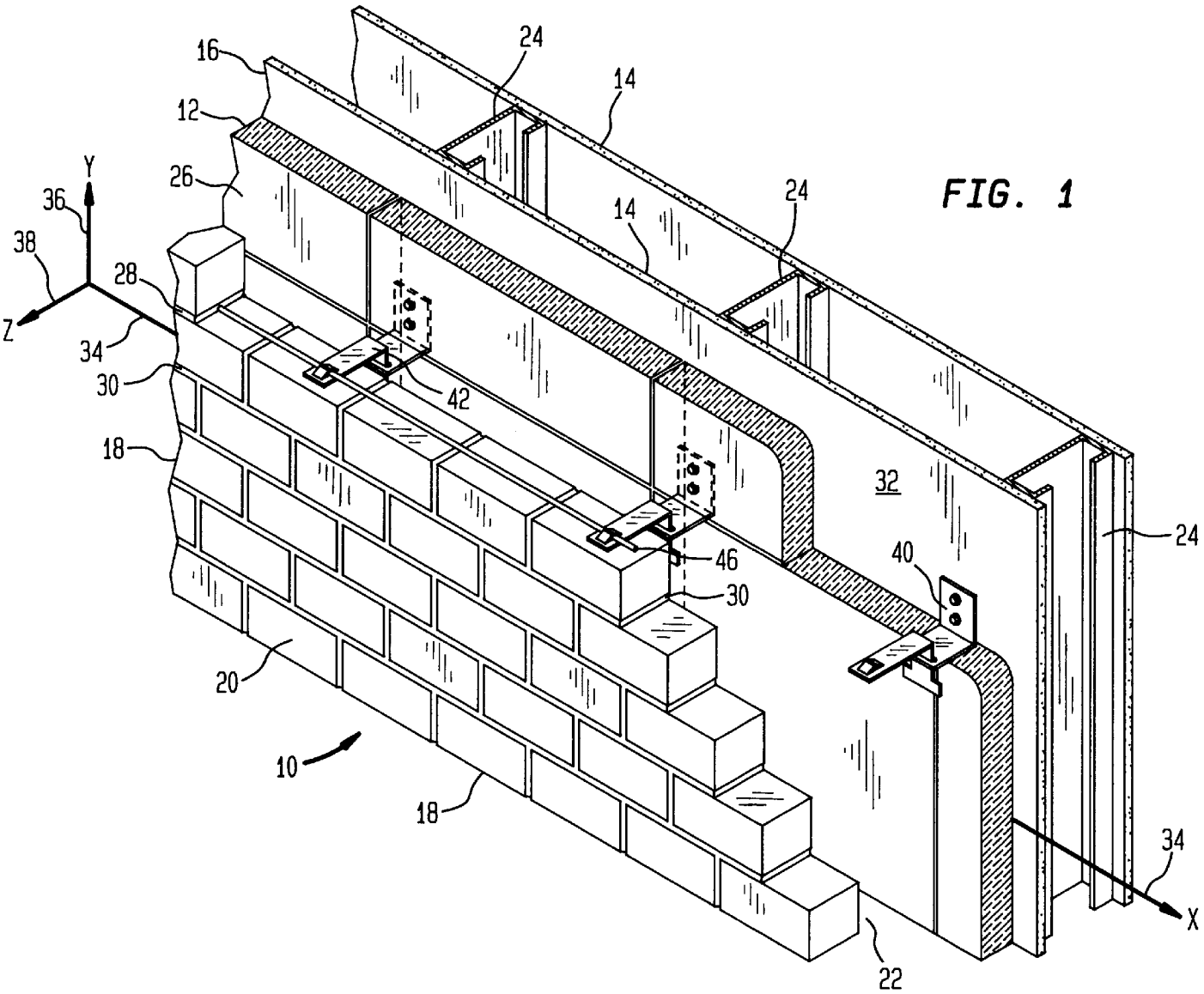
FIG. 1 is a perspective view of a first embodiment of a brick veneer anchor with a horizontal bent plate of this invention and shows, in combination a wall with two wythes with the inner wythe having a dry wall anchor and a T-head bent stay interconnecting the dry wall anchor and a continuous reinforcement wire in the outer wythe.
Figure 2:
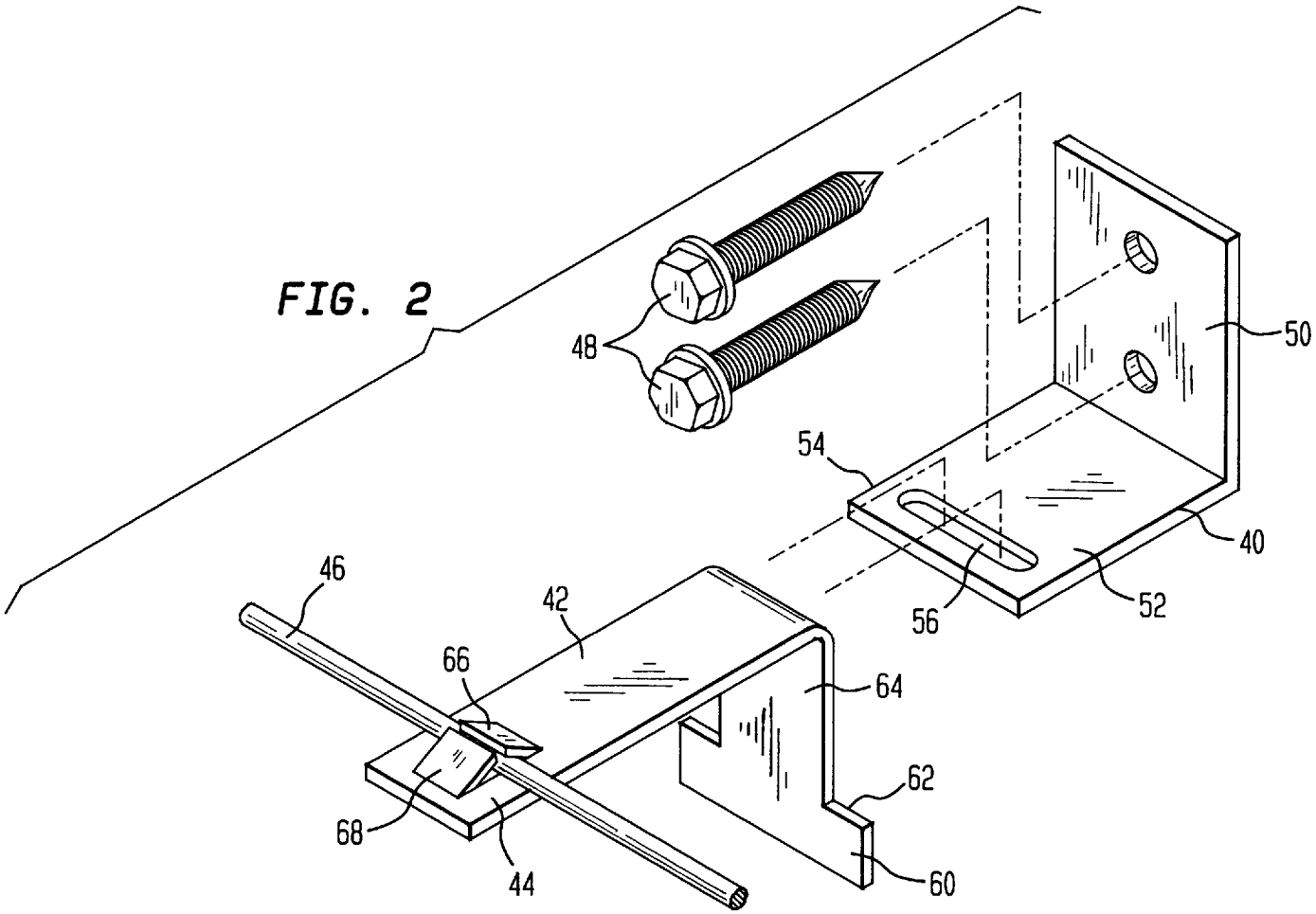
FIG. 2 is an exploded view of the brick veneer anchor and the continuous reinforcement wire of FIG. 1.
Figure 3:
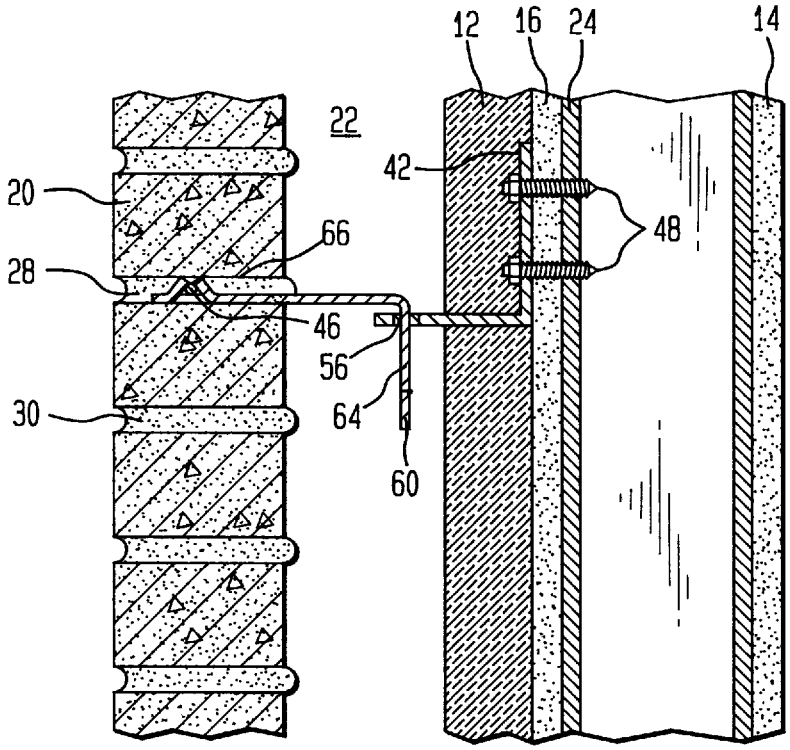
FIG. 3 is a partial cross-sectional view of the wall structure, the brick veneer anchor, and the continuous reinforcement wire of FIG. 1.

Referring now to FIGS. 1 to 3, the first embodiment of a brick veneer anchor of this invention is shown and is referred to generally by the numeral 10. A wall structure 12 is shown having an interior wythe 14 of insulated, dry wall panels 16 and an exterior wythe 18 of facing brick 20. Between the interior wythe 14 and the exterior wythe 18, a cavity 22 is formed. The interior wythe 14 is supported by a plurality of studs 24 to which dry wall panels 16 are attached and are insulated by an insulation 26 disposed on the face of the panels. The studs are substantially disposed vertically and those shown are metal, box-type studs.

Successive bed joints 28 and 30 are formed between courses of bricks 20 and the bed joints are substantially planar and horizontally disposed. Specific plate mounting locations on the studs 24 and bed joint 28 are selected to align so that the bent stay portion described hereinbelow is approximately centered in the elongated slot of the bent plate. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes. The brick veneer anchor 10 includes a bent plate fitting 40 constructed for attachment to stud 24 and a bent stay 42 constructed for embedment in bed joint 28. In the best mode, the bent stay 42 is constructed with an end portion 44 which accommodates reinforcement wire 46. The bent plate fitting 40 is shown in FIG. 1 as being attached to a stud with a bent stay 42 interlocked therewith in preparation for embedment in the mortar of bed joint 28.

Referring now to FIG. 2, the first embodiment of this invention is shown in detail. The bent plate 40 of the brick veneer anchor is constructed for attachment to the dry wall construct 14 by attaching hardware 48 securing the first or rear plate portion 50 to metal studs 24. The attaching hardware 48 are stainless steel, self-tapping screws. The bent plate 40 is mountable on the xy-plane 34 and 36 of the dry wall 16 and has a front plate 52 normal to the xy-plane. While, in the present mode, the bent plate 40 is mounted so that the second or front plate portion 52 lies in an xz-plane 34 and 38. The bent plate 40 is dimensioned, so that upon installation, the front plate portion 52 extends horizontally through the insulation 26 into the cavity 22. The extension portion 54 of bent plate 40 is that portion which extends beyond insulation 26. The extension portion 54 has an elongated aperture 56 therethrough.

A bent stay 42, upon installation using the aforementioned opening, has a back leg or T-head portion 60, which is constructed interlock with aperture 56. A shoulder portion 62 is dimensioned to limit excursions along the x-axis 34, and the neck portion 64, along the y-axis 36. The end portion 44 of bent stay 42 is dimensioned, with the bent stay in the installed condition, to span the cavity 22 and to terminate approximately in the medial portion of bed joint 28. The end portion 44 further includes tabs 66 and 68 which are spaced apart to encapture therewithin reinforcement wire member 46. While stamped tabs are shown as a reinforcement wire capturing mechanism, it is understood that a number of other mechanical arrangements, such as grooves or channels or combinations of tabs with grooves or channels can optionally be employed. Whatever configuration is used, care is exercised that the bed joint 28 height specification is maintained. With the embedment of the reinforcement wire in bed joint 28 and of the related portions of bent stay 42, to wit: tabs 66 and 68 and part of end portion 44 of bent stay 42, the T-head portion 60, the shoulder portion 62, and the neck portion 64 are held in a positive manner so that, even with seismic forces, the T-head portion 60 is entrapped in elongated slot or aperture 56.

Figure 4:
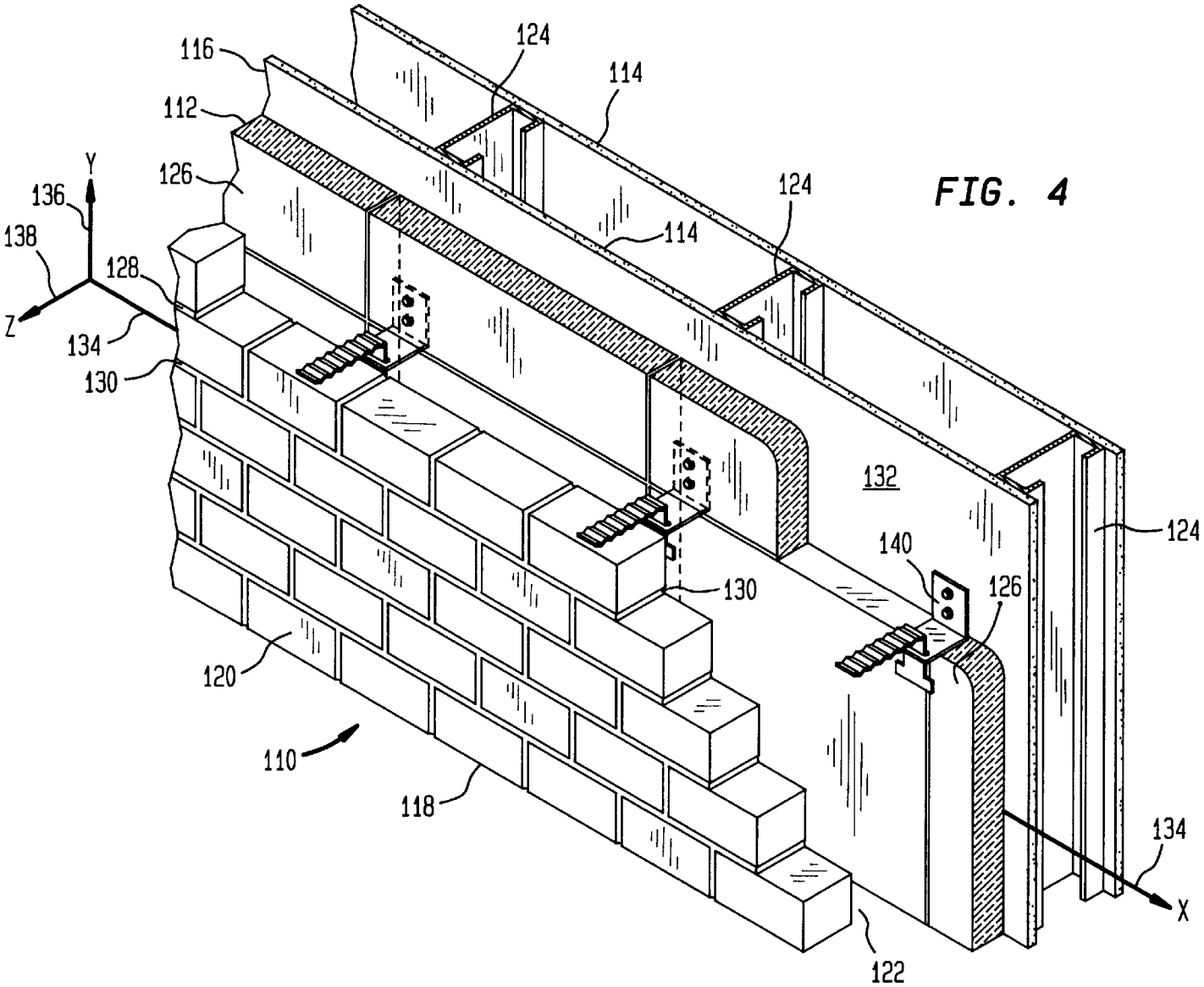
FIG. 4 is a perspective view of a second embodiment of the brick veneer anchor, similar to FIG. 1, but shows T-head bent stay with a corrugated portion; and, FIG. 5 is an exploded view of the brick veneer anchor of FIG. 4.
Figure 5:
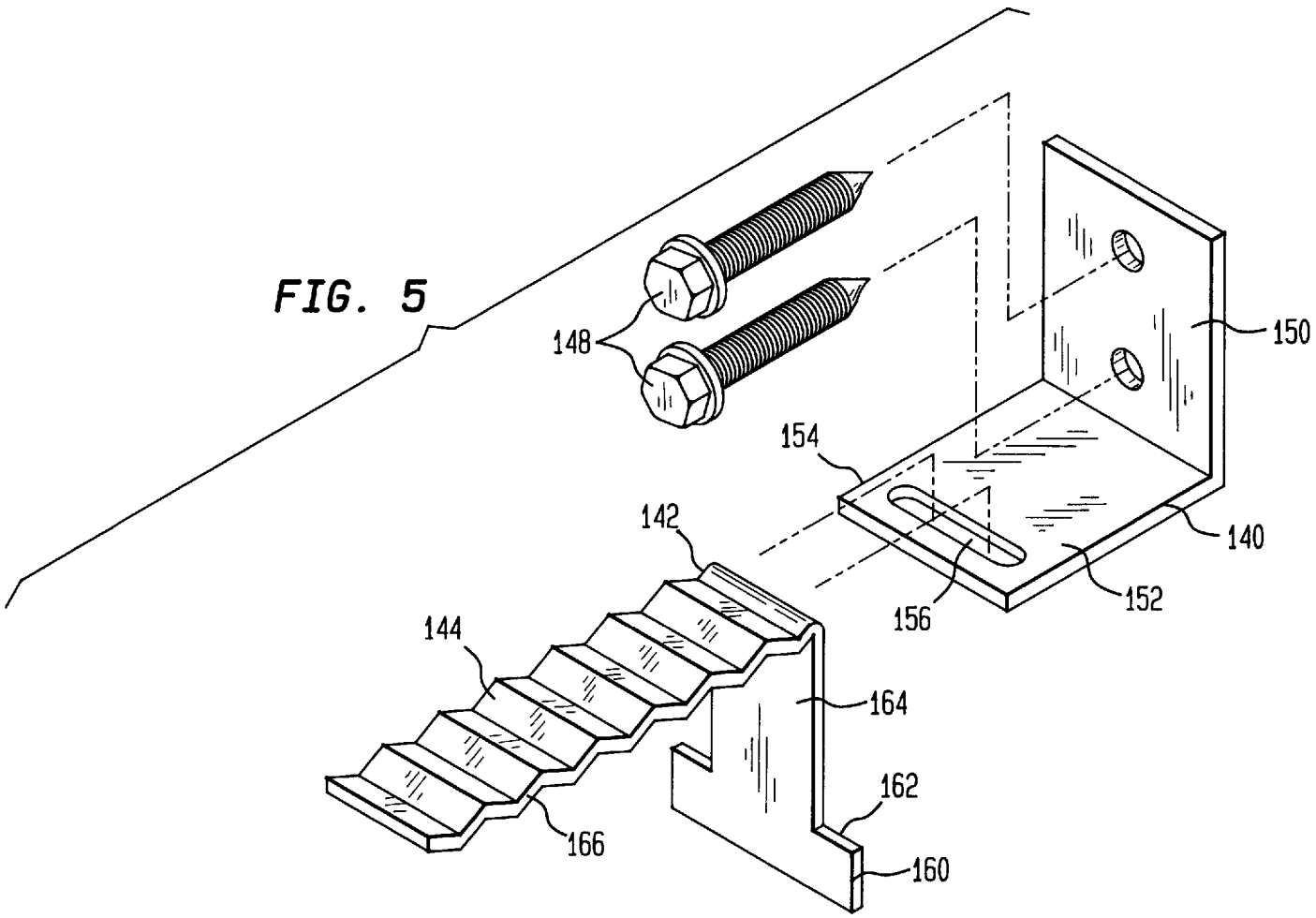

Referring now to FIGS. 4 and 5 a second embodiment of a brick veneer anchor is described. For ease of comprehension, where similar parts are used reference designators "100" units higher are employed. Thus, the bent plate 140 of the second embodiment is analogous to the bent plate 40 of the first embodiment. The second embodiment of a brick veneer anchor of this invention is shown and is referred to generally by the numeral 110. A wall structure 112 is shown having an interior wythe 114 of insulated, dry wall panels 116 and an exterior wythe 118 of facing brick 120. Between the interior wythe 114 and the exterior wythe 118 of facing brick 120, a cavity 122 is formed. The dry wall construct 114 is supported by a plurality of studs 124 to which dry wall panels 116 are attached and are insulated by an insulation 126 disposed on the face of the panels. The studs are substantially vertically disposed and those shown are metal, box-type studs. Successive bed joints 128 and 130 are formed between courses of bricks 120 and the joints are substantially planar and horizontally disposed. Specific plate mounting locations on the studs 124 and bed joints 128 are selected to align so that, upon installation, the T-head bent stay described hereinbelow lies approximately in the center of the y-axis travel limits. For purposes of discussion, the exterior surface 132 of the interior wythe 114 contains a horizontal line or x-axis 134 and an intersecting vertical line of y-axis 134 and an intersecting vertical line of y-axis 136. A horizontal line or z-axis 138 also passes through the coordinate origin formed by the intersecting x- and y-axes. The bent plate fitting 140 is shown in FIG. 5 as being attached to a stud in preparation for embedment in the mortar of bed joint 124. The bent stay or anchor 142 is a T-head bent stay with a first or corrugated portion 144 adapted, when installed to lie in an xz-plane 134 and 138 and to be embedded within bed joint 128. Further, the bent stay 142 has a second or lower portion 145 having, in turn, a T-head portion and a neck portion described in detail hereinbelow.

Referring now to FIG. 5, the second embodiment of this invention is shown in detail. The bent plate 140 of the brick veneer anchor is constructed for attachment to the dry wall construct 114 by attaching hardware 148 securing the first or rear plate portion 150 to metal studs 124. The attaching hardware 148 are stainless steel, self-tapping screws. The bent plate 140 is mountable on the xy-plane 134 and 136 of the dry wall 116 and has a front plate 152 normal to the xy-plane. In the second embodiment, the bent plate 140 is mounted so that the second or front plate portion 152 lies in an xz-plane 134 and 138. The bent plate 140 is dimensioned, so that, upon installation the front plate portion 152 extends through the insulation 126 to the cavity 122. The extension portion 154 of bent plate 140 is that portion which extends beyond insulation 126. The extension portion 154 has an elongated aperture 156 therethrough. Upon installation, the T-head portion 160 of bent stay 142 is interlocked with the aforementioned aperture 156. A shoulder portion 162 is constructed to limit excursions along the x-axis 134. A neck portion 164 is constructed to fit within the aperture 156. The aperture 156 then serves to limit excursions along the x-axis 134 by the difference between the width of the neck portion 164 and the opening of the aperture. The shoulder portion 162 and the neck portion 164 of T-head portion 160 are constructed so that the width of the neck and one shoulder is greater than aperture so that the width of the neck and one shoulder is greater than aperture 156. The length of the neck portion 164 serves to limit excursions along the y-axis 136 by mechanical stops upon reaching the upper portion 144 and the T-head portion 160. The other end of the bent stay 142 is dimensioned, with the bent stay in the installed condition, to span 122 and to terminate approximately in the medial portion of bed joint 128. The end portion 144 is constructed with a plurality of corrugations 166 so that, upon embedment in be joint 128, the bent stay is securely fastened.

By way of example, the foregoing description presents bent stays 42 and 142 as having differing configurations to adapt to varying uses, such as usages with and without reinforcement wires. It is within the contemplation of the present invention that other variations are applicable. For example, although all of the bent stays shown are adapted for particular applications, the variety provided is not exhaustive and other similar designs are within the contemplation of this invention. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A brick veneer anchor for use in the construction of wall structures having an inner wythe and an outer wythe in spaced apart relationship forming a cavity therebetween, said inner wythe having an insulative layer mounted on the outer surface thereof, said brick veneer anchor comprising, in combination:

a dry wall anchor having an L-shaped plate, said L-shaped plate having a first plate portion adapted for attachment to the outer surface of said inner wythe and a second plate portion disposed normal to said first plate portion and adapted to extend beyond said insulative layer into and to terminate within said cavity;

an elongated slot formed in said second plate portion and, with the dry wall anchor installed, adapted to be disposed in said cavity, said elongated slot adapted to lie in a plane normal to the inner wythe surface with a longitudinal axis of the elongated slot parallel to the inner wythe surface;

a bent stay having a first end thereof being interlockingly disposed in said elongated slot portion and a second end extending from said first end and adapted to be embedded within said outer facing wythe, said first end further comprising:

a T-head portion having a length greater than said longitudinal axis of said elongated slot, said T-head portion having a neck portion attached medially along the length of said T-head portion and to said second end, said T-neck portion forming shoulders on either side of said T-neck portion; and, said dry wall anchor, upon attachment to said inner wythe with said first end of said bent stay being rotatingly inserted in the elongated slot of said dry wall anchor and said second end of the bent stay being embedded in said outer wythe, the bent stay and the dry wall anchor are positively interlocked the one to the other;

whereby, upon use in construction of the a brick veneer anchor hereof, a wall structure resistant to seismic forces is formable thereby.

2. A brick veneer anchor as described in claim 1, when viewed in relation to said wall structure wherein a horizontal line within the outer surface plane of the outer wythe wall defines the x-axis, an intersecting vertical line within the said outer surface plane defines the y-axis, and a line normal thereto and passing through the intersection defines the z-axis, and wherein, said elongated slot has a predetermined length and the longitudinal axis of said elongated slot is adapted to align with the x-axis, said elongated slot permits and limits the degree of freedom-of-movement of the brick veneer anchor along the x-axis thereby establishing an x-axis, mechanical displacement threshold limit.

3. A brick veneer anchor as described in claim 2 wherein said outer wythe is a brick veneer of successive courses of brick with bed joints therebetween, further comprising:

at least one reinforcement wire adapted to be disposed longitudinally in said outer wythe and adapted for securement to said second end of said bent stay member;

reinforcement wire capturing means for encapturing said reinforcement wire, said capturing means formed in said second end of said bent stay dimensioned to accommodate said at least one reinforcement wire in a nesting fashion.

4. A brick veneer anchor as described in claim 2 wherein said outer wythe is a brick veneer of successive courses of brick with bed joints therebetween of predetermined height, said second end of said bent stay further comprising:

a plurality of corrugations adapted to be substantially aligned with said x-axis and when embedded in said bed joint adapted to prevent said first end of said bent stay from being removed from said dry wall anchor, the height of said plurality of corrugations adapted to be less than said predetermined bed joint height.

5. A brick veneer anchor as described in claim 2 wherein, said neck portion has a predetermined length and the longitudinal axis of said neck portion is adapted to align with the y-axis, said first end of said bent stay permits and limits the degree of freedom-of-movement of the brick veneer anchor along the y-axis, thereby establishing a y-axis, mechanical displacement threshold limit.

6. A brick veneer anchor as described in claim 5 wherein said outer wythe is a brick veneer of successive courses of brick with bed joints therebetween, further comprising:

at least one reinforcement wire adapted to be disposed longitudinally in said outer wythe and adapted for securement to said second end of said bent stay;

reinforcement wire capturing means for encapturing said reinforcement wire, said capturing means formed in said second end of said bent stay dimensioned to accommodate said at least one reinforcement wire in a nesting fashion.

7. A brick veneer anchor as described in claim 5 wherein said outer wythe is a brick veneer of successive courses of brick with bed joints therebetween of predetermined height, said second end of said bent stay further comprising:

a plurality of corrugations adapted to be substantially aligned with said x-axis and when embedded in said bed joint adapted to prevent said first end of said bent stay from being rotatable removed from said dry wall anchor, the height of said plurality of corrugations adapted to be less than said predetermined bed joint height.

8. A brick veneer and anchor for use in the construction of wall structures having a inner dry wall, said dry wall having a plurality of horizontally spaced vertical studs with dry wall panels therebetween and an insulative layer mounted on the outer surface thereof, said brick veneer and anchor comprising, in combination:

a brick veneer in spaced apart relationship from said dry wall forming a cavity therebetween, said brick veneer formed from courses of brick with bed joints between the courses;

an L-shaped anchor, in turn, comprising:

an attachment portion adapted for attachment to the outer surface of said dry wall;

an interlocking portion disposed normal to said attachment portion and adapted to extend beyond said insulative layer into and to terminate within said cavity;

an elongated slot having a longitudinal axis formed in said interlocking portion, said elongated slot adapted to lie, upon installation, in a plane normal to the dry wall surface; and, a bent stay having a T-head portion with a length greater than the length of said elongated slot and having a first end thereof disposed in said elongated slot and interlocking with said L-shaped anchor, said bent stay having a plate portion with a second end thereof extending from said T-head portion and being embedded within said brick veneer and, upon embedment in said brick veneer restricts the rotational movement of the brick veneer and thereby positively interlocks said L-shaped anchor and said bent stay.

9. A brick veneer and anchor as described in claim 8 wherein said bent stay further comprises:

a neck portion attached medially along the length of said T-head portion and to said plate portion, said T-head portion forming shoulders on either side of said T-neck portion.

10. A brick veneer and anchor as described in claim 9, when viewed in relation to said wall structure, wherein a horizontal line within the outer surface plane of the dry wall defines the x-axis, an intersecting vertical line within the said outer surface plane defines the y-axis, and a line normal thereto and passing through the intersection defines the z-axis, and wherein, said elongated slot has a predetermined length and the longitudinal axis of said elongated slot is adapted to align with the x-axis, said elongated slot permits and limits the degree of freedom-of-movement of the brick veneer along the x-axis.

11. A brick veneer and anchor as described in claim 10 further comprising:

at least one reinforcement wire disposed longitudinally in said brick veneer and secured to said second end of said bent stay;

reinforcement wire capturing means for encapturing said reinforcement wire, said capturing means formed in said second end of said bent stay dimensioned to accommodate said at least one reinforcement wire in a nesting fashion.

12. A brick veneer and anchor as described in claim 9 wherein said bed joints are of a predetermined height, said second end of said bent stay further comprising a plurality of corrugations substantially aligned with said x-axis and when embedded in said bed joint preventing said first end of said bent stay being rotatingly removed from said L-shaped anchor, said plurality of corrugations within the predetermined bed joint height.

13. A brick veneer and anchor as described in claim 9 wherein, said neck portion has a predetermined length and the longitudinal axis of said neck portion is adapted to align with the y-axis, said first end of said bent stay permits and limits the degree of freedom-of-movement of the brick veneer anchor along the y-axis, thereby establishing a y-axis, mechanical displacement threshold limit.

14. A brick veneer and anchor as described in claim 13, further comprising:

at least one reinforcement wire disposed longitudinally in said brick veneer and;

reinforcement wire capturing means for encapturing said reinforcement wire, said capturing means formed in said second end of said bent stay dimensioned to accommodate said at least one reinforcement wire in a nesting fashion.

15. A brick veneer and anchor as described in claim 14 wherein said bed joints are of a predetermined height, said second end of said bent stay further comprising a plurality of corrugations substantially aligned with said x-axis and when embedded in said bed joint preventing said first end of said bent stay being rotatingly removed from said L-shaped anchor, said plurality of corrugations within the predetermined bed joint height.

* * * * *